US006447210B1

(12) United States Patent
Coombs

(10) Patent No.: US 6,447,210 B1
(45) Date of Patent: Sep. 10, 2002

(54) RESIN NOZZLE POSITIONER

(75) Inventor: Perry L. Coombs, Claremont, NH (US)

(73) Assignee: Oldenburg Cannon, Inc., Claremont, NH (US)

( * ) Notice: Subject to any disclaimer, the term of this patent is extended or adjusted under 35 U.S.C. 154(b) by 0 days.

(21) Appl. No.: 09/793,361

(22) Filed: Feb. 26, 2001

(51) Int. Cl.[7] ..... E21D 20/02
(52) U.S. Cl. ..... 405/259.5; 405/303
(58) Field of Search ..... 405/259.5, 259.6, 405/259.1, 303, 302.2, 302.1; 173/184, 38, 39, 194, 42

(56) References Cited

U.S. PATENT DOCUMENTS 4,215,953 A * 8/1980 Perraud ..... 405/259.6
4,229,124 A * 10/1980 Frey et al. ..... 405/303
4,398,850 A * 8/1983 Talvensaari ..... 405/303
4,832,536 A * 5/1989 Spross et al. ..... 405/303
5,114,279 A * 5/1992 Bjerngren et al. ..... 405/259.1
5,494,380 A 2/1996 Morrison et al. ..... 405/269
5,556,235 A 9/1996 Morrison et al. ..... 405/303
5,690,449 A 11/1997 Morrison et al. ..... 405/303
5,720,582 A 2/1998 Morrison et al. ..... 405/303
5,951,208 A * 9/1999 Wilson et al. ..... 405/259.6

OTHER PUBLICATIONS

Two digital photographs of Fletcher resin injection device.

* cited by examiner

*Primary Examiner*—H. Shackelford
*Assistant Examiner*—Frederick L. Lagman
(74) *Attorney, Agent, or Firm*—Michael J. Weins; Jeffrey E. Semprebon

(57) ABSTRACT

A resin nozzle positioner for a rock bolter, having a frame supporting feed tracks traversed by a drill and a bolt driver, has a resin nozzle that guides a resin sausage into a hole drilled along a work axis. A positioner base is fixed to the frame and two arms are pivotably connected to the positioner base and to a nozzle block, to which the resin nozzle is mounted. The arms remain parallel and move such that the resin nozzle remains parallel to the work axis while moving along an arc between a retracted position, where the resin nozzle is spaced apart from the work axis, and an extended position, where the resin nozzle is aligned with the work axis. An actuator operably connected to two elements selected from the arms, the positioner base, and the nozzle block serves to move the resin nozzle.

15 Claims, 9 Drawing Sheets

RESIN NOZZLE POSITIONER

FIELD OF THE INVENTION

The present invention relates to devices for installing resin set bolts into the ceiling and walls of a mine, and more particularly for a device for positioning a resin nozzle for injecting a resin sausage into a pre-drilled bolt hole.

BACKGROUND OF THE INVENTION

Rock bolts and associated bolt plates are used in underground structures such as mines to reinforce the rock. These rock bolts are installed by a rock bolter having a drill, which bores a bolt hole along a work axis, and a bolt driver, which places a bolt into the hole after the bolt has been brought to the work axis. When the bolt is to be held in place by resin, the rock bolter drills the bolt hole and thereafter a resin sausage is placed into the bolt hole. The casing of the resin sausage is broken by inserting a bolt into the bolt hole, and the resin from the sausage forms a bond between the bolt and the rock. To avoid premature breakage of the resin sausage, it is necessary to align the resin sausage with the hole prior to inserting it. While such alignment can be performed manually, such requires providing an operator access to the site of the hole, which can present safety risks and/or can delay the bolt setting operation. Thus, it is preferred to provide a resin nozzle having a nozzle axis in combination with a mechanism which can move the resin nozzle to align the nozzle axis with the work axis, thus aligning a nozzle passage of the resin nozzle, through which the resin sausage passes, with the bolt hole to guide the resin sausage thereinto. In some cases, a centralizer is provided on the rock bolter to guide the drill and thus define the location of the bolt hole. When a centralizer is provided, the nozzle passage need only be aligned with a centralizer passage of the centralizer, and the centralizer can serve to direct the resin sausage into the bolt hole. To insert the resin sausage, the resin nozzle must be moved into alignment with the bolt hole after the hole has been bored by the drill. After insertion, the resin nozzle must then be moved away from the hole to allow the bolt driver to advance the bolt into the hole. Thus, the resin nozzle must be moved reliably to and from a position where it is aligned with the bolt hole to guide the resin sausage therein.

One approach to the problem of positioning the resin nozzle for single feed track rock bolters is a device by J. H. Fletcher & Co., Inc. which uses a carousel for storage of a number of resin sausages. The resin nozzle is provided at one end of the carousel, and the resin sausages are sequentially rotated into alignment with the resin nozzle. When a resin sausage is so aligned, it is also aligned with a flexible extendable pusher which serves to push the resin sausage through the resin nozzle. The carousel is mounted to a frame of the rock bolter by a link, which is pivotably connected to both a top region of the carousel and to the frame so as to be disposed substantially parallel to a longitudinal nozzle axis of the resin nozzle, and by an arm, which is pivotably connected to a base region of the carousel and to the frame at a substantial inclination to the nozzle axis. The pivotable connection provided by the link and the arm allows the carousel to be moved by an actuator into a position in close proximity to the frame, or a position somewhat spaced apart from the frame to provide clearance for the advancement of the drill and the bolt driver. Thereafter, when the carousel is positioned in close proximity to the frame, it is pivoted about an axis parallel to the nozzle axis to bring the nozzle axis into substantial alignment with the work axis. The multiple actions make accurate alignment between the nozzle axis and the work axis difficult and may inhibit use of the device with some types of centralizers. In addition to requiring complex motion, the Fletcher device is both bulky and heavy, difficult to fabricate, and provides only very limited displacement of the resin nozzle. Additional problems are associated with the pusher for moving the resin sausages through the resin nozzle into the bolt hole.

An alternative approach to inserting resin sausages simplifies the introduction of the resin sausages into the resin nozzle and avoids some of the deficiencies of the Fletcher device by placing each resin sausage into a resin sausage insertion chamber that communicates with a flexible resin hose, which in turn communicates with the nozzle passage of the resin nozzle. The resin nozzle is aligned with the bolt hole and the resin sausage is passed into and through the resin hose and is directed into the bolt hole by the resin nozzle. Further discussion of the injection of resin sausages is found in U.S. Pat. No. 5,494,380, assigned to the assignee of the present application. While this system simplifies the introduction and advancement of the resin sausage through the resin nozzle, the system does not in and of itself offer a solution to the problem of positioning the resin nozzle.

The positioning of the resin nozzle for rock bolters which employ a single feed track has been addressed in U.S. Pat. No. 5,690,449, assigned to the assignee of the present application, which provides a solution when the feed track can be employed to guide a carriage on which the resin nozzle is advanced. Because the resin nozzle is advanced along the work axis, the device can be readily employed with a centralizer to guide the resin nozzle into alignment with the bolt hole. However, this approach places undesirable limits on the sizes of tool bases employed to mount the drill, the resin nozzle, and the bolt driver to the carriage for advancement along the feed track.

Thus, there is a need for a resin nozzle positioning device which does not require the use of a feed track, has a simple structure, and provides a large displacement of the resin nozzle to assure that the resin nozzle and related components do not interfere with the drilling or bolt setting apparatus. Furthermore, there is a need for a resin nozzle positioner which moves the resin nozzle onto the work axis with a substantial component of the motion being parallel to the work axis to facilitate the use of a centralizer to guide the resin nozzle.

SUMMARY OF THE INVENTION

The present invention provides a resin nozzle positioner for use with a rock bolter having a frame which supports one or more feed tracks for the advancement of a drill and a bolt driver along a work axis on which holes are bored and bolts are set into the holes. Preferably, the rock bolter has a centralizer which is also supported by the frame. When a centralizer is employed, it provides guidance and support for a drill rod of the rock bolter when the drill is advanced along the work axis to bore a hole in a rock surface, and thus the centralizer defines the location of the bolt hole. The centralizer can also provide support and guidance of a bolt during the bolt setting operation as the bolt is advanced along the work axis by the bolt driver. When the bolts are to be secured by use of a resin, a resin nozzle guides the insertion of a resin sausage into the hole prior to the setting of the bolt with the bolt driver. To insert the resin sausage into the hole, the resin nozzle is positioned such that the resin sausage is directed along the work axis and is guided into the bolt hole. The use of a centralizer having a centralizer passage with a centralizer axis that is aligned with the work axis simplifies the insertion of the resin sausage, since the resin nozzle need only be brought into registry with the centralizer.

The resin nozzle positioner of the present invention has a positioner base which is mounted so as to be fixable with respect to the frame of the rock bolter. Preferably, to better facilitate the alignment of a nozzle axis of the resin nozzle with the work axis, the positioner base is affixed with respect to the frame or made an integral part thereof.

A pair of arms are pivotably connected to the positioner base. The arms may each be fabricated from single piece of stock or may be fabricated from multiple pieces. When employing multiple pieces, a pair of parallel plates, one connected on either side of the positioner base, can be readily employed to provide an arm with a high strength to weight ratio.

Each arm terminates in an arm base end region and an arm free end region. Each of the base end regions is pivotably connected to the positioner base so as to pivot about a base pivot axis. The base pivot axes of the pair of arms are spaced apart by a separation S, and are both normal to the work axis. Preferably, the base pivot axes reside in a plane which is parallel to the work axis.

A nozzle block is provided, which is pivotably connected to each of the arm free end regions of the pair of arms so as to pivot about block pivot axes which again are spaced apart at the separation S and are normal to the work axis. The pair of arms have an effective length L which is defined as the distance between the base pivot axis and the block pivot axis of each of the arms. Employing arms with the same effective length L and so connecting the arm base end regions to the positioner base and the arm free end regions to the nozzle block assures that the arms are maintained parallel with each other during operation. As the arms are pivoted with respect to the positioner base and the nozzle block, the nozzle block is moved relative to the positioner base along an arc, while maintaining a constant orientation with respect to the work axis.

The resin nozzle is mounted to the nozzle block, and has a nozzle passage therethrough and a longitudinal nozzle axis. The nozzle passage directs the path of the resin sausage along the nozzle axis as it ejected from the resin nozzle. The resin nozzle moves in an arc with the nozzle block, and the resin nozzle is so mounted thereon that the nozzle axis maintains a parallel orientation with respect to the work axis as the arms are pivoted.

As the arms are pivoted, the resin nozzle moves between a retracted position and an extended position. In the retracted position, the arms are inclined at a minimum angle with respect to the work axis and at a minimum separation from each other, resulting in the resin nozzle being spaced away from alignment with the work axis so as to prevent interference with other elements of the rock bolter. In the extended position, the nozzle axis of the resin nozzle is substantially aligned with the work axis. When the resin nozzle is moved between the retracted and extended positions, the nozzle axis is displaced by a displacement D in a plane which contains the work axis. This condition is assured by making the plane containing the work axis and the nozzle axis normal to the pivot axes. Preferably, the arms are substantially normal to the nozzle axis of the resin nozzle when the resin nozzle is in its extended position. This facilitates the alignment of the nozzle axis with the work axis by minimizing the effect of slight translation of the resin nozzle with respect to either the bolt hole or the centralizer. When a centralizer is employed, this geometry allows the resin nozzle to approach its extended position with a substantial component of its motion being parallel to the work axis, which facilitates bringing the resin nozzle into engagement with the centralizer.

The position of the resin nozzle with respect to the other elements of the rock bolter are preferably so arranged that the nozzle passage is in close proximity to the bolt hole when the resin nozzle is in its extended position. It is preferred for the resin nozzle to be adjustably mounted to the nozzle block to allow its longitudinal position along the nozzle axis to be adjusted. When a centralizer is employed, the resin nozzle preferably engages the centralizer in the extended position.

The length L of the arms is selected to provide a sufficient displacement D that, when the resin nozzle is in its retracted position, it will not interfere with other elements of the rock bolter. Additionally, the resin nozzle positioner must be mounted with respect to the frame of the rock bolter so as to provide a clear arc in which the nozzle block and the resin nozzle can move.

The resin nozzle is preferably provided with a nozzle head which provides a reinforced structure to the end of the nozzle passage. When a centralizer is employed, the nozzle head is preferably configured to guidably engage the centralizer such that, when the resin nozzle is moved to its fully extended position, the nozzle passage of the resin nozzle is positioned adjacent to the centralizer passage of the centralizer and aligned therewith. The nozzle head is also preferably provided with a ramp surface which serves to prevent the nozzle head from becoming stuck on nearby structures when the resin nozzle is moved to its retracted position.

A flexible resin hose is connected to the resin nozzle to feed resin sausages thereto. Preferably, the flexible resin hose remains free of the remaining structure of the rock bolter to reduce the risk of entanglement or interference.

An actuator is provided, and is connected with respect to two of the following elements: the arms, the positioner base, and the nozzle block. The actuator can be connected either directly to these elements or to an element affixed to them, such as being fixed to the frame or the resin nozzle. In all cases, the actuator acts to move the arms such that the resin nozzle is moved between its retracted and extended positions.

Preferably, the actuator is a linear actuator, terminating in a first actuator end and a second actuator end, and the linear actuator can be activated to vary the separation between the first actuator end and the second actuator end. The first and second actuator ends of the linear actuator are pivotably connected as discussed above. Such linear actuators can be provided by a variety of devices known in the art such as jacks, rack and pinion mechanisms, or pneumatic or hydraulic cylinders.

In one further preferred embodiment, the first actuator end is pivotably attached to the frame of the rock bolter at a point spaced apart from the base pivot axes where the arm base end regions mount to the positioner base, and the second actuator end is pivotably attached to one of the arms at a position spaced apart from the base pivot axis. This arrangement is well suited to providing a substantial displacement D of the nozzle axis when moved between the extended and the retracted positions, while positioning the resin nozzle in close proximity to the frame in the retracted position.

BEST MODE OF CARRYING THE INVENTION INTO PRACTICE

Figure 1:
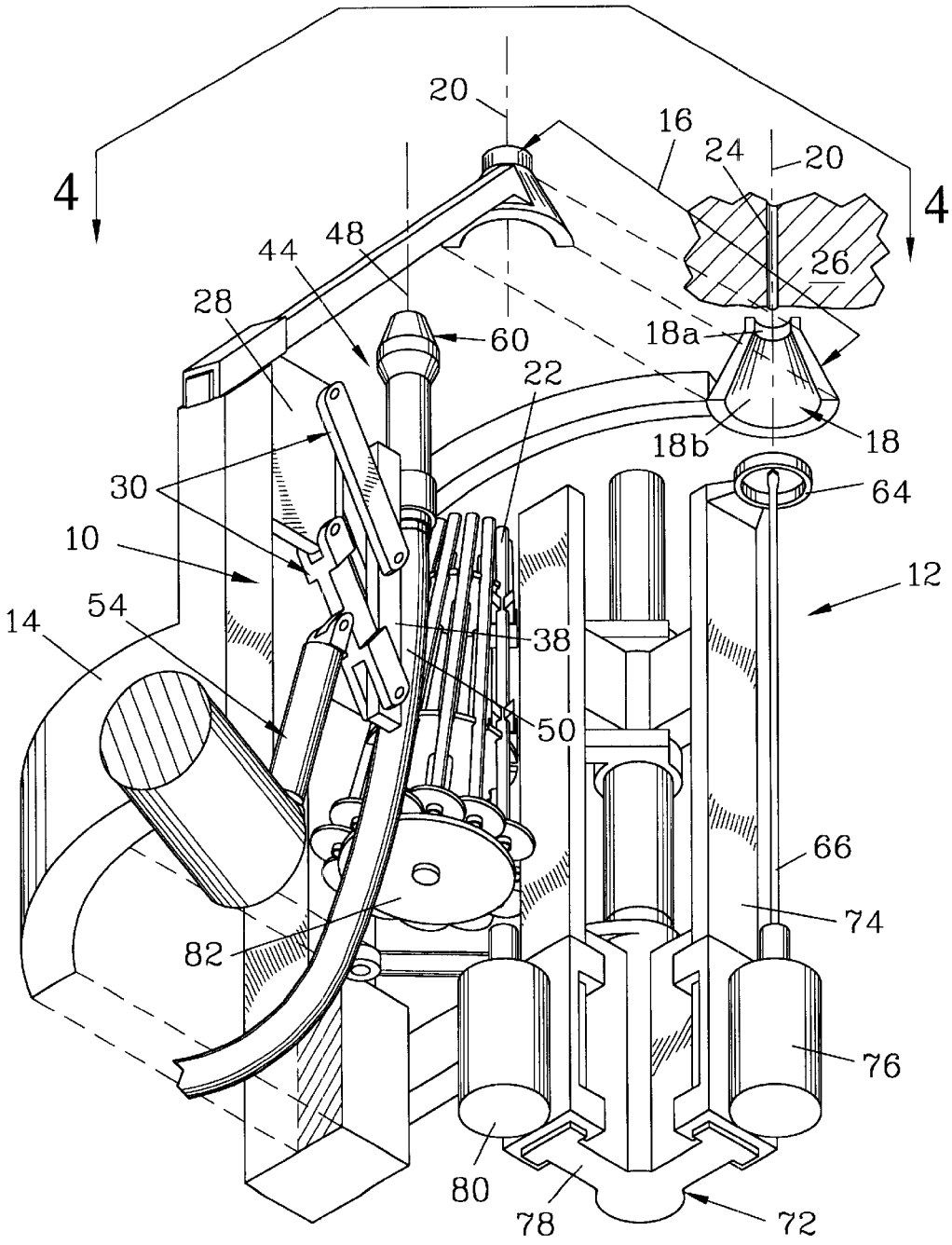
FIG. 1 is an isometric view showing a resin nozzle positioner which forms one embodiment of the present invention. The resin nozzle positioner is designed for use with a turret-type rock bolter having a combined stinger/centralizer, and is mounted to a frame element which supports one head of the stinger/centralizer. The resin positioner is shown with a resin nozzle in a retracted position.

FIGS. 1 through 4 illustrate a resin nozzle positioner 10 shown installed on a rock bolter 12. The rock bolter 12 illustrated is similar to the rock bolter described in U.S. patent application Ser. No. 09/691,736 and incorporated herein by reference. The rock bolter 12 has a frame 14 which supports a centralizer 16 having a centralizer passage 18 with a centralizer axis 20, which in this embodiment serves as a work axis. The centralizer passage 18 passes through the centralizer 16 and has a tubular section 18*a* as well as a conical section 18*b*. The centralizer passage 18 assists in aligning a resin sausage (not shown) and a rock bolt 22 with a bolt hole 24 which is drilled into a rock surface 26 into which the bolt 22 is to be set.

Figure 2:
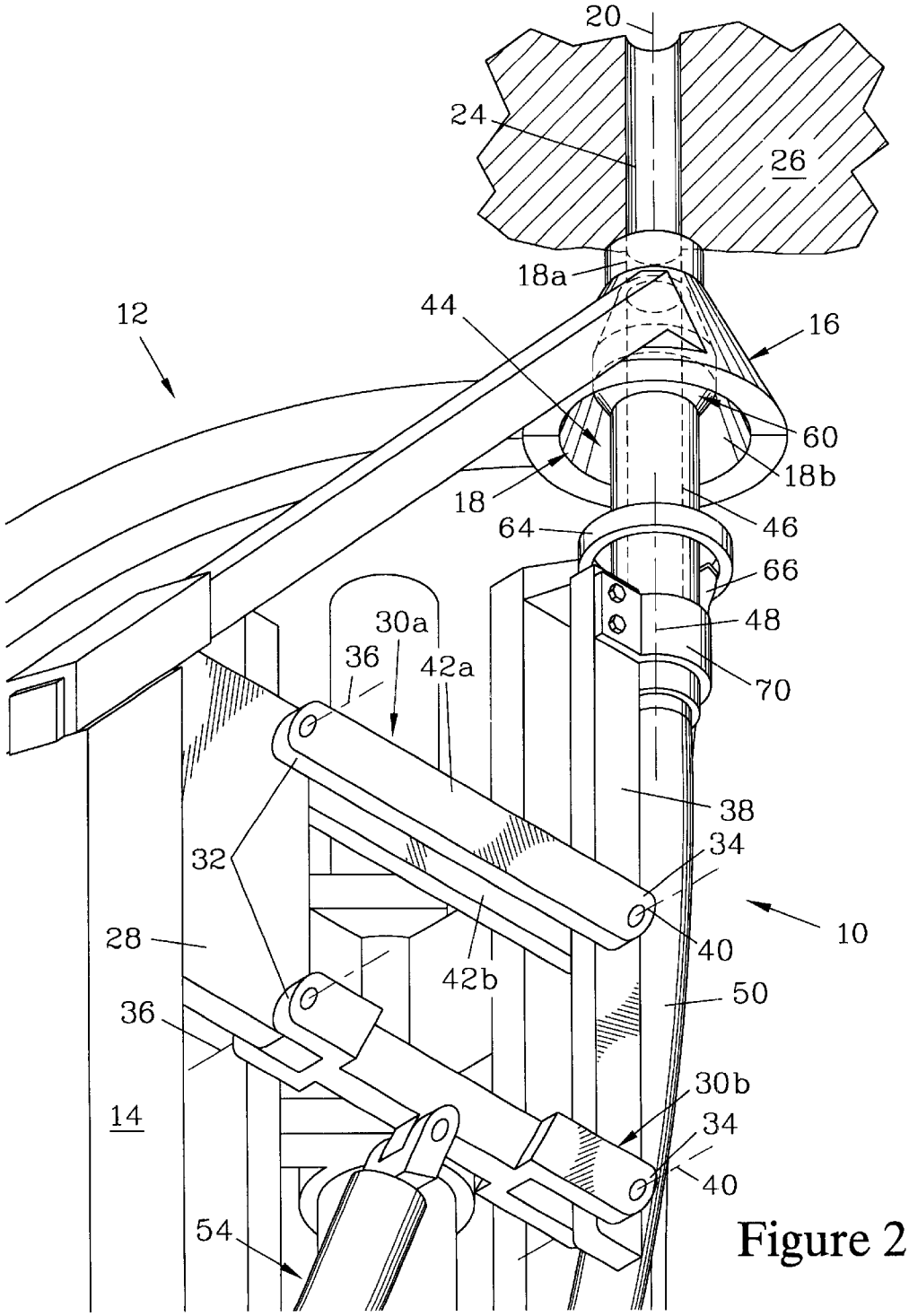
FIG. 2 is a partial isometric view of the embodiment shown in FIG. 1 where the resin nozzle is in an extended position, where it is aligned with a centralizer passage of the stinger/centralizer.

FIG. 1 illustrates the resin nozzle positioner 10 in a retracted position, while FIG. 2 illustrates the resin nozzle positioner 10 in an extended position where it resides when a resin sausage is injected into the bolt hole 24.

Figure 3:
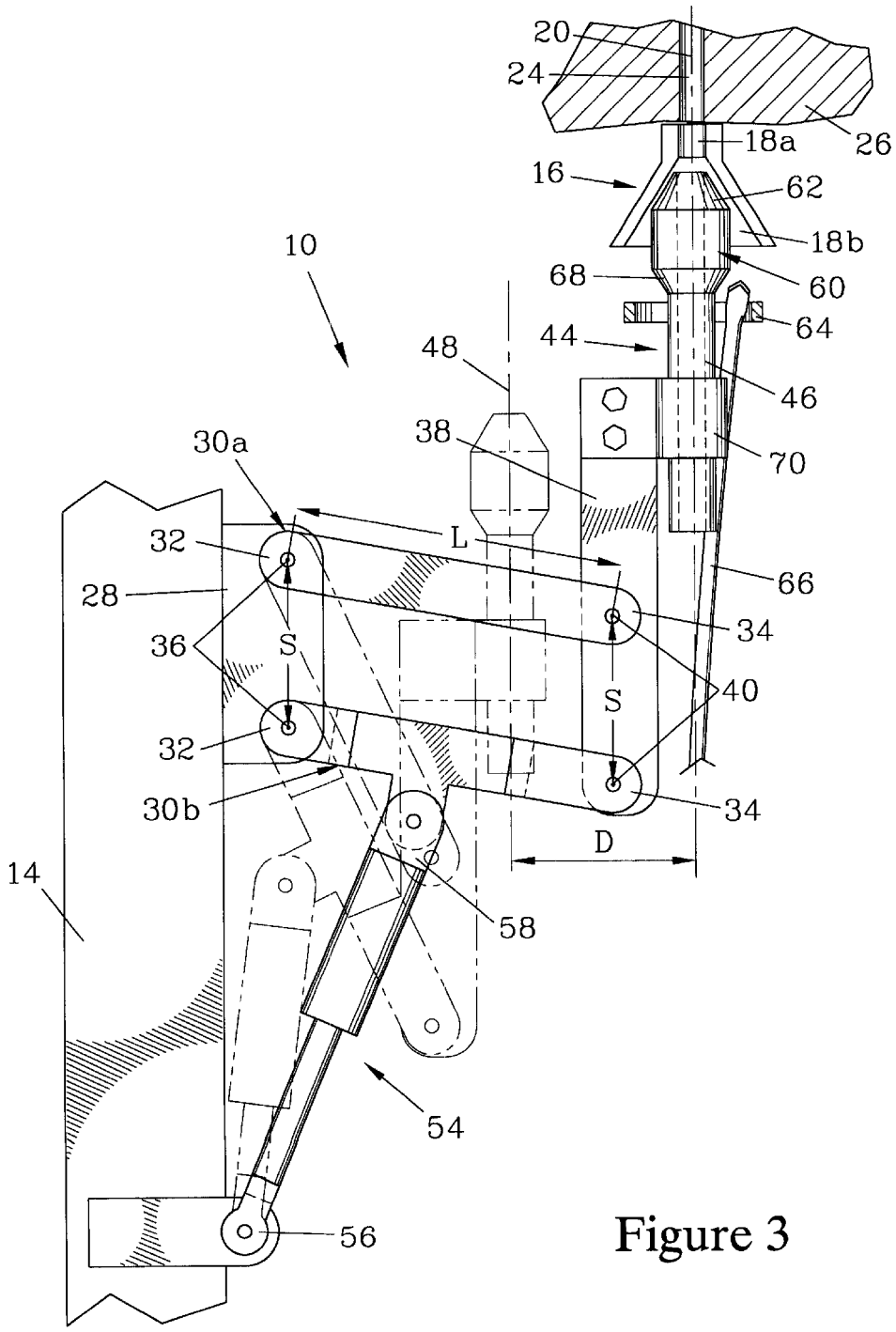
FIG. 3 is a schematic view of the resin nozzle positioner shown in FIGS. 1 and 2, illustrating the geometry of the components and the cooperation between a nozzle head of the resin nozzle and a centralizer passage of the stinger/centralizer as the resin nozzle approaches its extended position.

The resin nozzle positioner 10 has a positioner base 28, which in this embodiment is affixed to the frame 14 and can be made an integral part thereof. A pair of arms 30 are provided terminating in an arm base end region 32 and an arm free end region 34 (as indicated in FIGS. 2 and 3). The arm base end region 32 of each of the pair of arms 30 is pivotably attached to the positioner base 28 so as to pivot about base pivot axes 36 which are spaced apart at a separation S, as illustrated in FIG. 3. In this embodiment, the base pivot axes 36 define a plane which is parallel to the centralizer axis 20. Having the plane defined by the base pivot axes 36 parallel to or substantially parallel to the centralizer axis 20 facilitates adjusting the elements of the resin nozzle positioner 10 for proper alignment with respect to the centralizer axis 20.

A nozzle block 38 is pivotably attached to the arm free end regions 34 of each of the pair of arms 30 so as to pivot about block pivot axes 40 separated by the separation S. Furthermore, the length L of the arms 30 as measured by the distance between their respective pivot axes (36 and 40) is the same, thereby assuring that the pair of arms 30 remain at all times substantially parallel to each other.

It should be noted that, in the resin nozzle positioner 10, the arms 30 differ in the details of their structure but maintain a common length L. As best shown in FIG. 2, a first arm 30*a* is a split arm formed of a first plate 42*a* and a second plate 42*b* which straddle the positioner base 28 and the nozzle block 38. A second arm 30*b* is a single arm having the base end region 32 and the arm free end region 34 formed as devises such that the base 28 and the nozzle block 38 can be engaged thereby.

A resin nozzle 44 having a nozzle passage 46 (shown in hidden lines in FIGS. 2 and 3) and a nozzle axis 48 is provided. The nozzle passage 46 in turn communicates with a resin hose 50. The resin nozzle 44 is mounted on the nozzle block 38 and positioned such that the nozzle axis 48 is parallel to the centralizer axis 20, which is also the work axis. The nozzle axis 48 and the centralizer axis 20 define a plane 52 (shown in FIG. 4), to which the pivot axes (36 and 40) are all normal.

Figure 4:
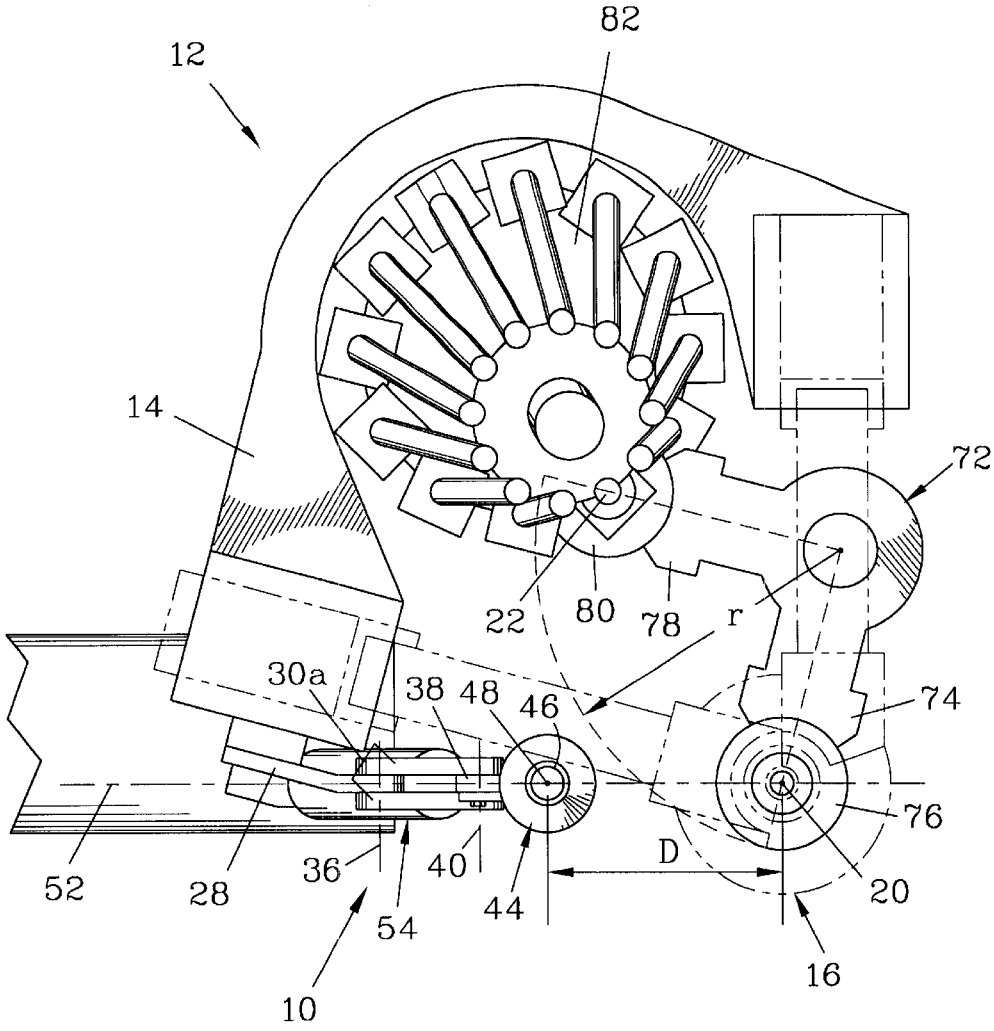
FIG. 4 is a view from the plane 4—4 of FIG. 1, further illustrating the position of the resin nozzle positioner with respect to other elements.

In the embodiment illustrated in FIGS. 1 through 4, means for displacing the resin nozzle positioner 10 between the retracted position shown in FIGS. 1 and 4 and the extended position illustrated in FIG. 2 is provided by a linear actuator 54. As shown in FIG. 3, the linear actuator 54 has a first actuator end 56, which in this embodiment is pivotably attached with respect to the positioner base 28 via the frame 14 of the rock bolter 12. The linear actuator 54 also has a second actuator end 58 which has a forked configuration. In this embodiment, the second actuator end 58 is pivotably engaged to the second arm 30*b* of the pair of arms 30. The linear actuator 54 can be selectively activated to vary the separation between the first actuator end 56 and the second actuator end 58, which causes the arms 30 to move the resin nozzle 44 between its retracted position (shown in phantom in FIG. 3) and its extended position, shown in FIG. 2. FIG. 3 shows the resin nozzle 44 when it is nearly at, but not at its fully extended position. In this embodiment, the linear actuator 54 is provided by a hydraulic cylinder which serves to vary the distance between the first actuator end 56 and the second actuator end 58. Other means, such as a rack and pinion, a jack, etc., could alternatively be employed. When a hydraulic cylinder is employed, it is preferably mounted such that the area where the piston enters the housing is protected from falling dust and debris, as illustrated in FIG. 3.

It is further preferred that the resin nozzle 44 be fitted with a nozzle head 60. FIG. 3 illustrates the nozzle head 60 in greater detail, where the resin nozzle 44 is close to its fully extended position. The nozzle head 60 is contoured to substantially conform to the conical section 18*b* of the centralizer passage 18 when brought in contact therewith. Contact is assured by having the resin nozzle 44 mounted on the nozzle block 38 such that the centralizer axis 20 is substantially aligned with the nozzle axis 48 when the nozzle block 38 is moved to the extended position. In this embodiment, the nozzle head 60 has a beveled guide surface 62 configured to match the contour of the conical section 18*b* of the centralizer passage 18, which provides a guide surface to assure alignment between the nozzle axis 48 and the centralizer axis 20.

The linear actuator 54, the arms 30, and the nozzle block 38 of this embodiment are so configured that, when the resin nozzle 44 is in its extended position, the pair of arms 30 are nearly normal to the nozzle axis 48. This is preferred since the path traveled by the nozzle head 60 as it approaches the extended position is substantially parallel to the centralizer axis 20, and thus the resin nozzle 44 has a large component of its motion parallel to the centralizer axis 20, facilitating engagement between the beveled guide surface 62 of the nozzle head 60 and the conical section 18*b* of the centralizer passage 18. Having the pair of arms 30 nearly normal to the nozzle axis 48 also serves to maximize the displacement of the resin nozzle 44 relative to its retracted position (shown in phantom in FIG. 3). Preferably, the actuator 54, the arms 30, and the nozzle block 38 are designed such that the nozzle axis 48 is aligned with the centralizer axis 20 when the arms are at a somewhat less than normal angle to the centralizer axis 20, for example at about 80°. Designing the components with such a geometry assures that there is some additional range of displacement to allow for adjustment if necessary to align the nozzle axis 48 with the centralizer axis 20 when the resin nozzle positioner 10 is installed to a particular rock bolter 12. As noted above, the adjustment necessary to align the nozzle axis 48 with the centralizer axis 20 is also facilitated by having the base pivot axes 36 reside in a plane which is parallel to the centralizer axis 20.

The rock bolter 12 illustrated has a retaining ring 64 which is employed to stabilize a drill rod 66. The diameter of the nozzle head 60 is maintained sufficiently small that it can freely pass through the retaining ring 64 while the drill rod 66 resides therein. When the resin nozzle 44 is moved to its extended position, it pushes the drill rod 66 out of alignment with the centralizer axis 20. The retaining ring 64 assures that the drill rod 66 remains within the footprint of the conical section 18*b* of the centralizer passage 18 so as to be guided therein when the drill rod 66 is advanced. To prevent engagement with either the retaining ring 64 or the drill rod 66 from blocking retraction of the resin nozzle 44, the nozzle head 60 is provided with a ramp surface 68 to guide the nozzle head 60 past any surrounding structures.

When the resin nozzle positioner 10 is installed on the rock bolter 12, the throw of the linear actuator 54 is adjusted so as to position the nozzle axis 48 in alignment with the centralizer axis 20. Similarly, the longitudinal position of the resin nozzle 44 with respect to the nozzle block 38 is adjusted to place the nozzle head 60 into engagement with the centralizer 16, such that the nozzle passage 46 joins the tubular section 18*a* of the centralizer passage 18. This longitudinal adjustment can be readily provided by mounting the resin nozzle 44 to the nozzle block 38 by a clamp assembly 70 (shown in FIGS. 2 and 3). When the clamp assembly 70 is loosened, the resin nozzle 44 slidably engages the clamp assembly 70, allowing longitudinal adjustment of the position of the resin nozzle 44. Once positioned, the clamp assembly 70 is tightened to affix the resin nozzle 44 with respect to the nozzle block 38.

FIG. 4 is a view from the plane 4—4 of FIG. 1, where the resin nozzle 44 is positioned in the retracted position. For clarity, the centralizer 16 and its related structure are shown in phantom. When the resin nozzle 44 is moved between the retracted position (shown) and the extended position (shown in FIG. 2) where the nozzle axis 48 is positioned on the centralizer axis 20, which in this embodiment is also the work axis, the nozzle axis 48 is moved by a displacement D in the plane 52 defined by the nozzle axis 48 and the centralizer axis 20. The linear actuator 54, the arms 30 (only one of which is shown), and the nozzle block 38 must be configured such that the displacement D is sufficient to move the resin nozzle 44 away from the centralizer axis 20 to a retracted position where there is no interference with other bolt setting operations. The rock bolter 12 has a turret 72 (illustrated in FIGS. 1 and 4) pivotably mounted to the frame 14. The turret 72 in turn supports a drill feed track 74, traversed by a rock drill 76 to which the drill rod 66 is mounted. The retracted position of the resin nozzle positioner 10 must be such as to allow the rock drill 76 to freely traverse the drill feed track 74. Likewise, when the centralizer 16 resides over the turret 72 as illustrated in FIGS. 1 and 4, the resin nozzle 44 and the nozzle head 60 must be advancable to the centralizer axis 20 without interference with the drill feed track 74 or the rock drill 76.

The turret 72 also has mounted thereon a driver feed track 78, which is traversed by a bolt driver 80. A bolt magazine 82, which sequentially supplies the bolts 22 to the bolt driver 80, is also mounted to the frame 14. The position of the resin nozzle positioner 10 is also selected such that the resin nozzle 44 and the nozzle block 38 can be moved through the plane 52 between the retracted and extended positions without interference with the drill feed track 74, the driver feed track 78, or the bolt magazine 82.

In this embodiment, the resin nozzle 44 is moved into its extended position after the rock drill 76 has been moved on the drill feed track 74 to withdraw the drill rod 66 from the bolt hole 24 (shown in FIGS. 1–3). The drill rod 66 resides on the centralizer axis 20 as the resin nozzle 44 is moved to its extended position but, as noted above, the drill rod 66 is sufficiently flexible that it can be pushed off the centralizer axis 20 by the resin nozzle 44, and thus does not interfere with motion of the nozzle 44 to its extended position. The radial position of the resin nozzle positioner 10 should also be selected such that it does not interfere with the view of the operator and does not project beyond other structures where it would increase the overall size of the rock bolter 12 and would be susceptible to damage as the rock bolter 12 is moved into position in a mine environment.

When the turret 72 is rotated to move the bolt 22 engaged by the bolt driver 80 onto the centralizer axis 20, the combination of the bolt 22, the bolt driver 80, and the driver feed track 78 sweep out a surface of revolution, schematically indicated in FIG. 4 by the radius r. When in its retracted position, the resin nozzle 44 and related structures reside outside the radius r to prevent interference with the bolt 22, the bolt driver 80, the driver feed track 78, or the drill feed track 74 as the turret 72 rotates.

Figure 5:
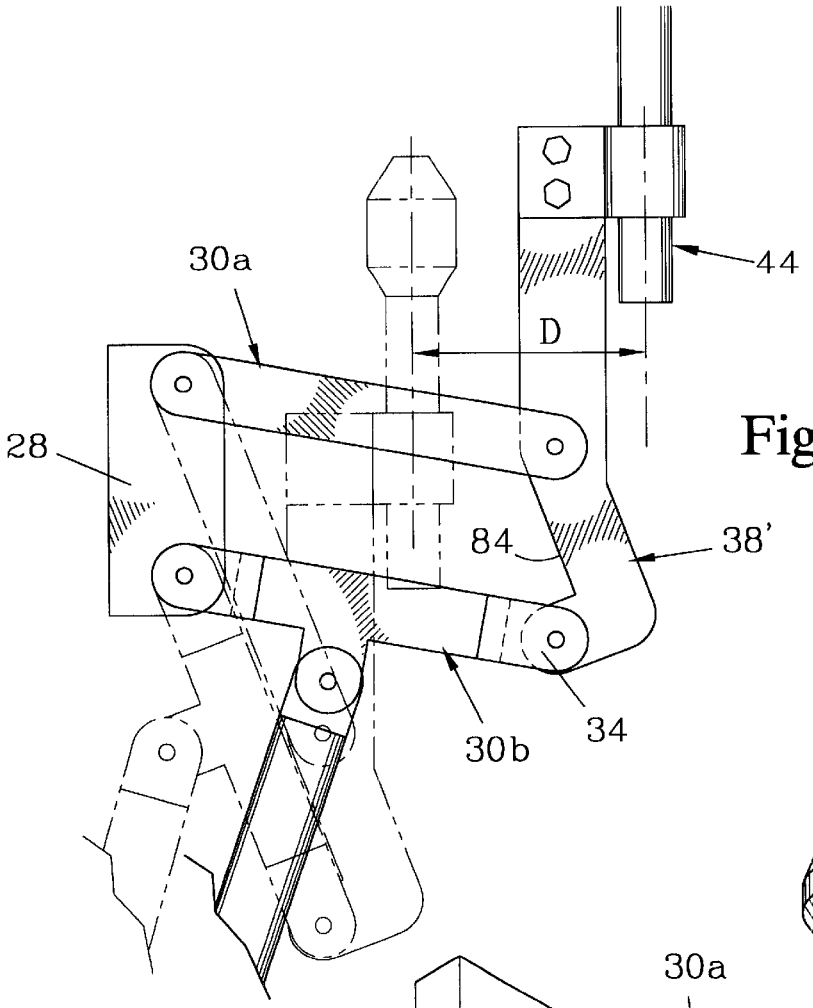
FIG. 5 illustrates an alternate nozzle block which can be employed in the embodiment shown in FIGS. 1–4 to provide a greater displacement of the resin nozzle from a work axis.

FIG. 5 illustrates an alternative nozzle block 38' which can be employed to provide an increased displacement D over the embodiment shown in FIGS. 1–4. The nozzle block 38' is contoured with a second arm recess 84 which allows the arms 30 to be retracted closer to the positioner base 28 by preventing interference between the arm free end region 34 of the second arm 30*b* and the nozzle block 38' as the resin nozzle 44 is retracted. In this embodiment, the retracted position of the resin nozzle 44 can be defined by the contact of the arms 30 with each other, rather than by contact between the arm free end region 34 of the second arm 30*b* and the nozzle block 38'.

Figure 6:
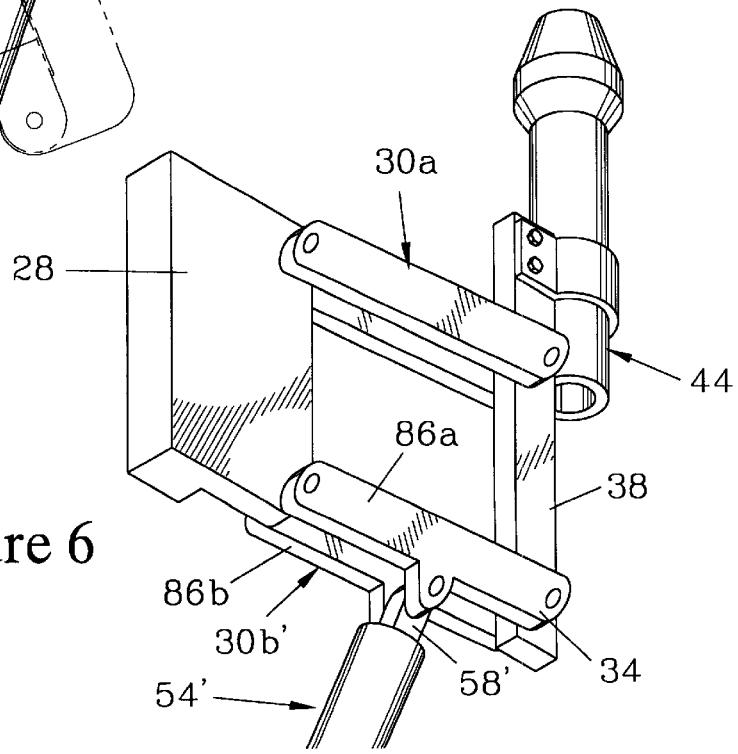
FIG. 6 illustrates an alternative two-part the lower arm which can provide increased displacement similar to that of the embodiment shown in FIG. 5 without requiring use of the nozzle block of that embodiment.

FIG. 6 illustrates another alternative to provide an increased displacement D by preventing interference between the arm free end region 34 of the second arm 30*b*' and the nozzle block 38. In this embodiment, a linear actuator 54' is employed that has a second actuator end 58' which is formed as a tab, rather than having a forked configuration. In this case, the second arm 30*b*' is a two-part arm, similar to the first arm 30*a*. The second arm 30*b*' has a second arm first plate 86*a* and a second arm second plate 86*b* which reside on either side of the positioner base 28, the nozzle block 38, and the second actuator end 58'.

Figure 8:
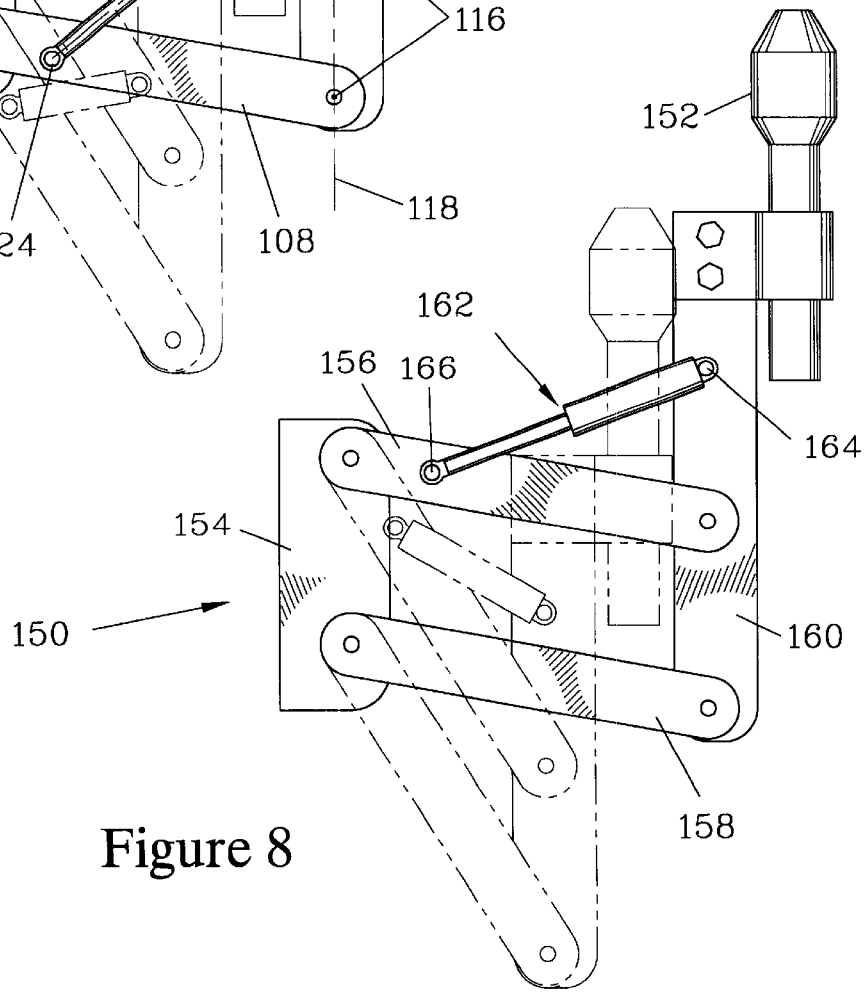
FIG. 8 illustrates another alternate connection scheme for a linear actuator which can be employed in the embodiment shown in FIGS. 1–4.
Figure 9:
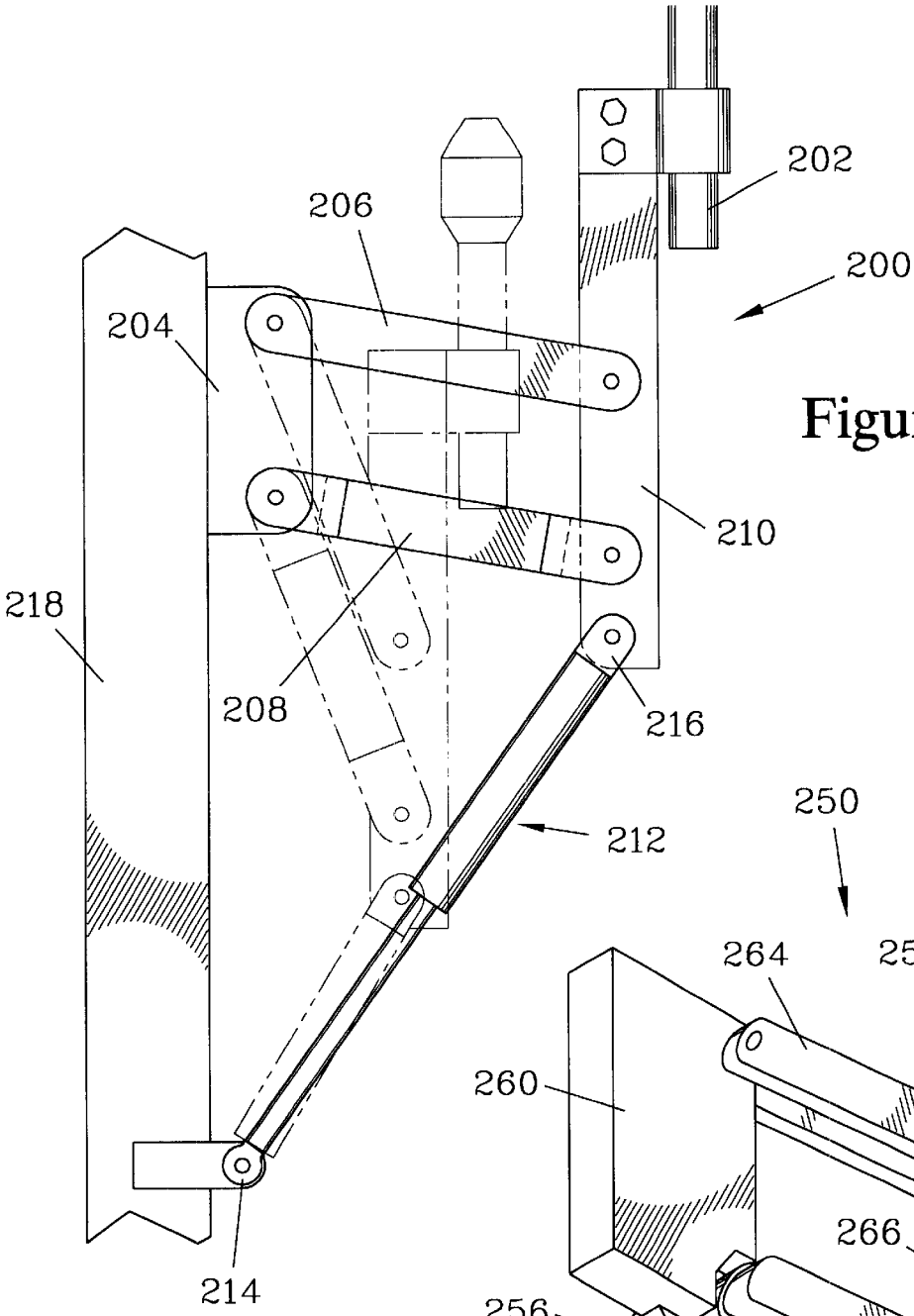
FIG. 9 illustrates yet another alternate connection scheme for a linear actuator which can be employed in the embodiment shown in FIGS. 1–4.

While the connection of a linear actuator between the frame and the second arm as discussed above has been found effective, it should be appreciated that a variety of other schemes for the connection of the actuator could be employed. In fact, the actuator may be pivotably attached with respect to any two elements selected from the group of elements comprising the pair of arms, the positioner base, and the nozzle block. A few of these alternative combinations are illustrated in FIGS. 7–9.

Figure 7:
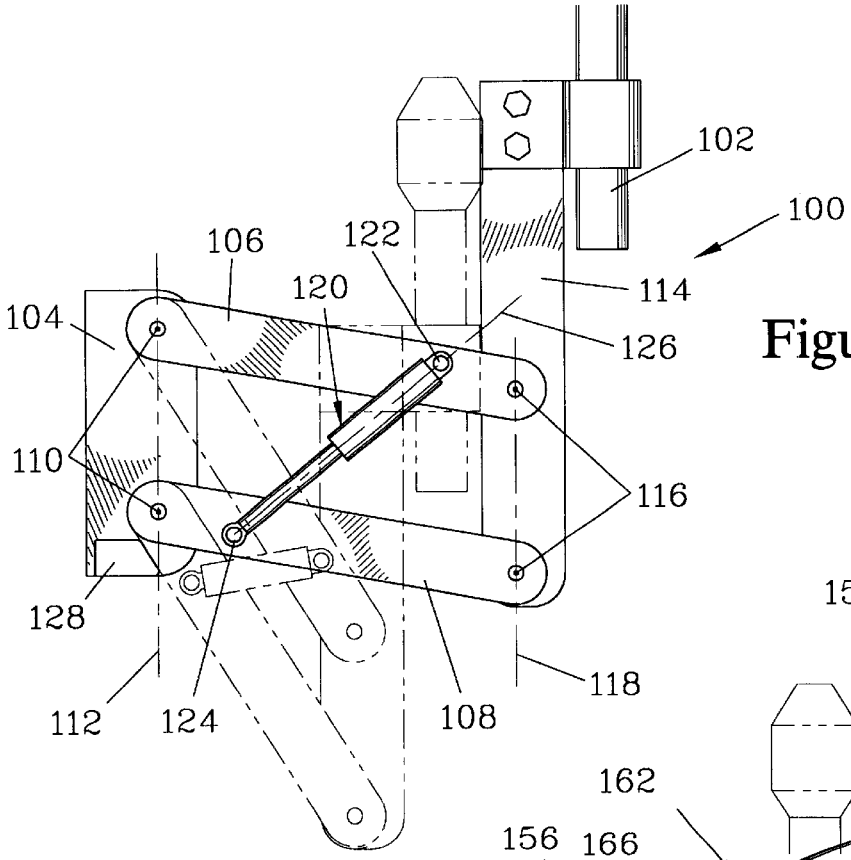
FIG. 7 illustrates an alternate connection scheme for a linear actuator which can advance and retract the resin nozzle in the embodiment shown in FIGS. 1–4.

FIG. 7 illustrates a resin nozzle positioner 100 for positioning a resin nozzle 102. The resin nozzle positioner 100 has a positioner base 104, to which a first arm 106 and a second arm 108 are pivotably attached at base pivot points 110 which define a base axis 112. A nozzle block 114, to which the resin nozzle 102 is mounted, is also pivotably attached to the first arm 106 and the second arm 108. The attachment of the first arm 106 and the second arm 108 to the nozzle block 114 is located at block pivot points 116, which define a block axis 118 that is parallel to the base axis 112.

In this embodiment, a linear actuator 120 is provided, having a first actuator end 122 that is pivotably connected to the first arm 106. The linear actuator 120 also has a second actuator end 124, which is pivotably connected to the second arm 108. The connection of the linear actuator 120 to the first arm 106 and the second arm 108 is configured such that a longitudinal actuator axis 126 of the linear actuator 120 is substantially inclined with respect to the base axis 112 and the block axis 118. When the linear actuator 120 is activated to increase the separation between the first actuator end 122 and the second actuator end 124, the separation between the first and second arms (106 and 108) is increased, forcing the first and second arms (106 and 108) to rotate to move the resin nozzle 102 from a retracted position (shown in phantom) to an extended position as illustrated.

A reaction block 128 is preferably provided on the positioner base 104, and in this embodiment is positioned such that it is engaged by the second arm 108 when the resin nozzle 102 is in its retracted position. The reaction block 128 provides a set reference position for the second arm 108 to help assure that the force acting to increase the separation between the first and second arms (106 and 108) is directed into causing rotation of the first and second arms (106 and 108), thereby avoiding problems of alignment which might occur due to wear on the base pivot points 110. The set reference position provided by the reaction block 128 forces the first arm 106 and the second arm 108 to rotate to displace the resin nozzle 102 to accommodate the increased separation between the first actuator end 122 and the second actuator end 124. It should be appreciated that a reaction block could be positioned to engage the first arm 106 in place of or, more preferably, in addition to the reaction block 128 positioned to engage the second arm 108.

FIG. 8 illustrates a resin nozzle positioner 150 which employs another arrangement for positioning a resin nozzle 152. The resin nozzle positioner 150 again has a positioner base 154, to which a first arm 156 and a second arm 158 are pivotably attached. A nozzle block 160, to which the resin nozzle 152 is mounted, is also pivotably attached to the first arm 156 and the second arm 158. A linear actuator 162 is provided, having a first actuator end 164 and a second actuator end 166. In this embodiment, the first actuator end 164 is pivotably connected to the nozzle block 160, while the second actuator end 166 is pivotably connected to the first arm 156. The linear actuator 162 can be activated to increase the separation between the first actuator end 164 and the second actuator end 166 to move the resin nozzle 152 between a retracted position, shown in phantom, and an extended position as illustrated.

FIG. 9 illustrates a resin nozzle positioner 200 employing yet another arrangement for positioning a resin nozzle 202. The resin nozzle positioner 200 has a positioner base 204, to which a first arm 206 and a second arm 208 are pivotably attached, and a nozzle block 210, to which the resin nozzle 202 is mounted and which is also pivotably attached to the first arm 206 and the second arm 208. Again, a linear actuator 212 is provided, having a first actuator end 214 and a second actuator end 216. In this embodiment, the first actuator end 214 is pivotably connected to the positioner base 204 via a frame 218 to which the positioner base 204 is affixed, and the second actuator end 216 is pivotably connected to the nozzle block 210. The linear actuator 212 can be activated to increase the separation between the first actuator end 214 and the second actuator end 216 to move the resin nozzle 202 between a retracted position, shown in phantom, and an extended position, as shown.

Figure 10:
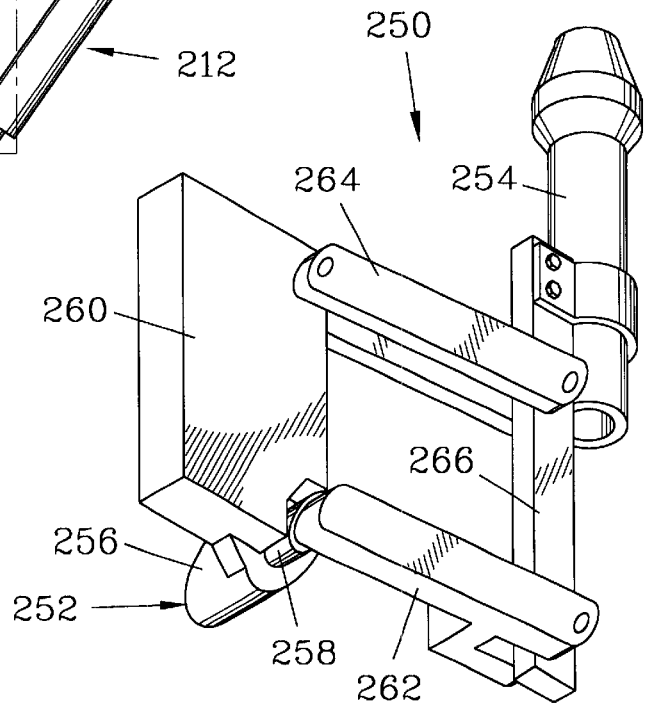
FIG. 10 illustrates a resin nozzle positioner which employs a rotary actuator in place of a linear actuator such as used in the embodiment shown in FIGS. 1–4.

FIG. 10 illustrates a resin nozzle positioner 250 which differs from the above described embodiments in that it employs a rotary actuator 252 for positioning a resin nozzle 254. The rotary actuator 252 has a housing 256 and an output shaft 258, and can be activated to forcibly rotate the output shaft 258 relative to the housing 256.

The resin nozzle positioner 250 again has a positioner base 260, to which the housing 256 of the rotary actuator 252 is affixed. The output shaft 258 is affixed to a first arm 262, the rotation between the output shaft 258 and the housing 256 serving to provide a pivotable connection of the first arm 262 with respect to the positioner base 260 in this embodiment. A second arm 264 is directly pivotably attached to the positioner base 260. Both the first arm 262 and the second arm 264 are pivotably attached to a nozzle block 266, to which the resin nozzle 254 is mounted. The rotary actuator 252 can be activated to rotate the output shaft 258 relative to the housing 256, and thus rotate the first arm 262 with respect to the positioner base 260. The second arm 264 remains parallel to the first arm 262 as the first arm 262 is rotated, and both arms (262 and 264) serve to move the resin nozzle 254 between a retracted position (not shown) and an extended position, as illustrated. While the use of the rotary actuator 252 simplifies the structure of the resin nozzle positioner 250, the size of the housing 256 may limit the ability to retract the arms (262 and 264) and thus may limit the displacement D which can be attained.

Figure 11:
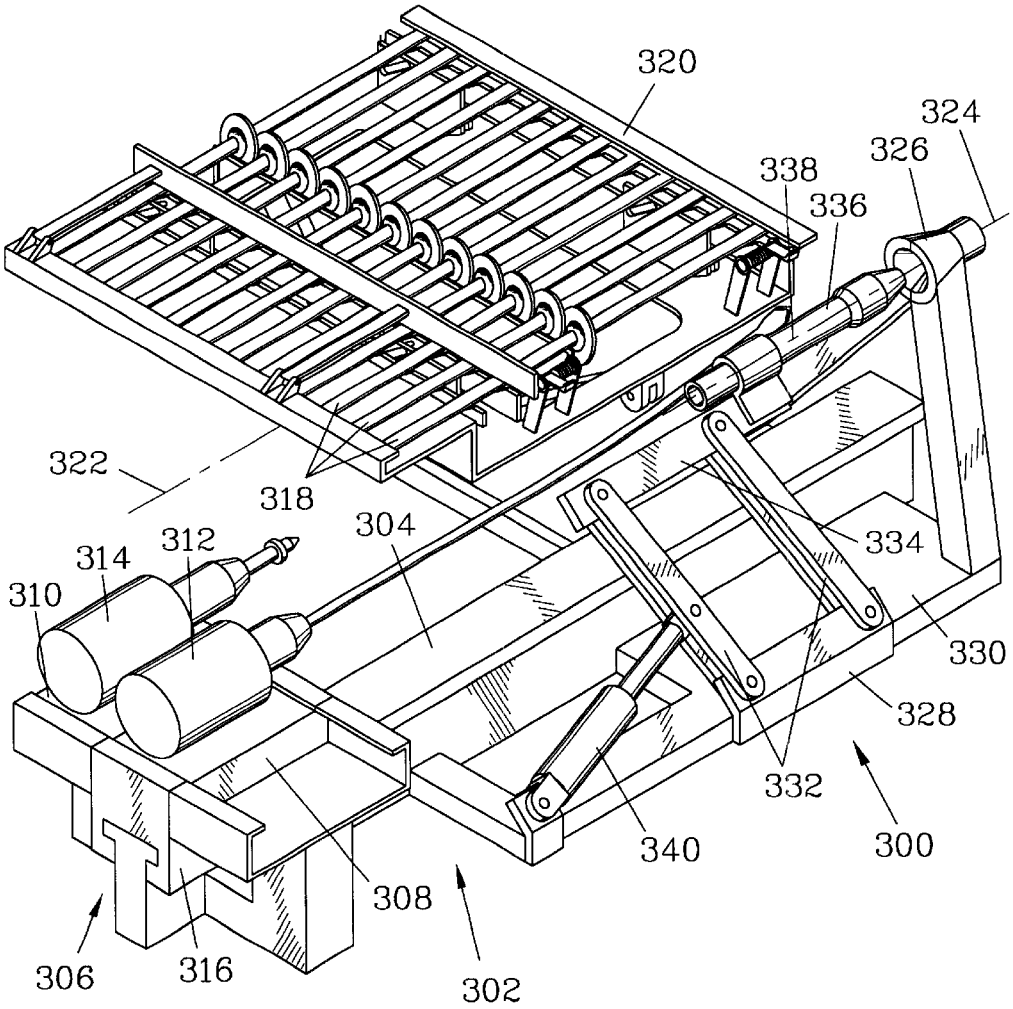
FIG. 11 is an isometric view of another embodiment of the present invention, a resin nozzle positioner designed for use with a single feed track rock bolter. In this embodiment, the positioner base of the resin nozzle positioner is mounted to the frame of the rock bolter.

FIG. 11 illustrates a resin nozzle positioner 300 which employs similar elements to those of the resin nozzle positioner 10 discussed above; however the resin nozzle positioner 300 is designed for use with a rock bolter 302 which employs a single feed track 304. Such single feed track rock bolters 302 are well known in the art, and are discussed in U.S. Pat. Nos. 5,556,435; 5,690,449; and 5,720,582, incorporated herein by reference. The rock bolter 302 has a slide assembly 306 which is slidably engaged by a drill base 308 and a driver base 310. A rock drill 312 is mounted to the drill base 308, while a bolt driver 314 is mounted on the driver base 310. The drill base 308 and the driver base 310 can be selectively positioned along the slide assembly 306 to position either the drill base 308 or the driver base 310 onto a carriage 316, which can then be advanced along the feed track 304 to either advance the rock drill 312 to bore a bolt hole (not shown), or advance the bolt driver 314 to insert a bolt 318 into the bolt hole. The rock bolter 302 also has a bolt magazine 320 which pivots about a bolt magazine axis 322 between a parked position, as illustrated, and a work position (not shown), and can be fixed in either position. When the bolt magazine 320 is fixed in its parked position, it is spaced apart from a work axis 324 to allow the drill 312 or the bolt driver 314 to be advanced along the feed track 304 past the bolt magazine 320. When the bolt magazine 320 is in its work position, one of the bolts 318 in the bolt magazine 320 is aligned with the work axis 324 such that, when the driver base 310 is positioned on the carriage 316, the carriage 316 can be advanced to bring the bolt driver 314 into engagement with the bolt 318. Once the bolt 318 is engaged by the bolt driver 314, the bolt magazine 320 is returned to its parked position to allow the bolt driver 314 to advance further to drive the bolt 318 into the bolt hole. Preferably, a centralizer 326 is provided to assure that the bolt 318 is directed into the bolt hole bored by the rock drill 312.

The resin nozzle positioner 300 for this embodiment has a positioner base 328 which is affixed to a frame 330 which is affixed to the feed track 304 and also supports the centralizer 326. A pair of arms 332 pivotably engage the positioner base 328. The pair of arms 332 also pivotably engage a nozzle block 334 which supports a resin nozzle 336 having a resin nozzle axis 338. A linear actuator 340 is pivotably connected to the frame 330 and to one of the pair of arms 332. The positioner base 328 is further oriented such that the nozzle axis 338 and the work axis 324 remain in a common plane.

The resin nozzle positioners 300 has benefits over resin nozzle positioners which mount the resin nozzle on a nozzle base which is advanced on the carriage, such as is taught in the '449 patent. The use of the resin nozzle positioner 300 reduces limitations on the size of the drill base and the driver base, and can reduce the size of the slide assembly necessary to accommodate all the tool bases. Additionally, since only two bases are employed, these bases can be made uniform with those for rock bolters which do not employ resin to set the bolts, such as those designed for use with split-set bolts, thereby reducing inventory requirements. Finally, the use of the separate resin nozzle positioner 300 reduces the complexity of the mechanism for indexing the drill base and the driver base on the carriage.

Figure 12:
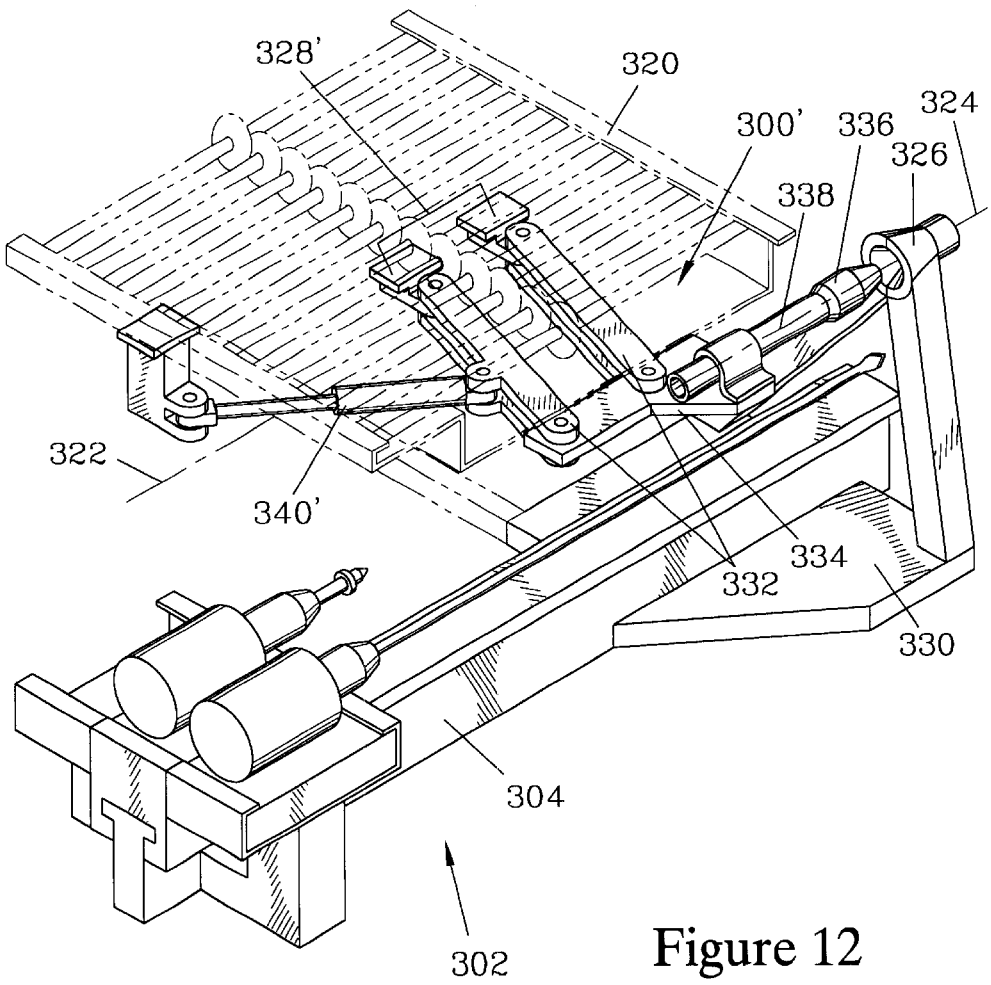
FIG. 12 is an isometric view of another embodiment designed for use with a single feed track rock bolter. In this embodiment, the positioner base of the resin nozzle positioner is mounted to the frame via a bolt magazine which can be fixed in a park position.

FIG. 12 illustrates an alternative resin nozzle positioner 300' which can be employed in the rock bolter 302. In this embodiment, a positioner base 328' is attached to the bolt magazine 320 (shown in phantom) rather than to the feed track 304, and a linear actuator 340' is pivotably connected to the bolt magazine 320 and to one of the pair of arms 332. However, with respect to all other elements, the resin nozzle positioner 300' is essentially the same as the resin nozzle positioner 300. Thus, in this embodiment the positioner base 328' is pivotably mounted with respect to the feed track 304; however, the bolt magazine 320 pivots about the magazine axis 322 which is parallel to the work axis 324. Thus, the positioner base 328' is fixable between two positions, both of which are fixed with respect to the frame 330 to which the bolt magazine 320 is mounted. The positioner base 328', the pair of arms 332, and the nozzle block 334 are oriented such that their pivot axes are normal to a plane containing the nozzle axis 338 and the work axis 324 when the bolt magazine 320 is fixed in its parked position.

To assure that the resin nozzle 336 is only moved to its extended position when the bolt magazine 320 is fixed in its parked position, it is preferred to disable the linear actuator 340' when the bolt magazine 320 is moved away from the parked position. Similarly, to avoid pivoting the bolt magazine 320 while the resin nozzle 336 is extended, it is preferred to disable motion of the bolt magazine 320 unless the resin nozzle 336 is in its retracted position. The resin nozzle positioner 300' is configured such that the resin nozzle 336 and related structure, when retracted, are positioned where they do not interfere with the motion of the bolt magazine 320 between its parked and work positions.

While the novel features of the present invention have been described in terms of particular embodiments and preferred applications, it should be appreciated by one skilled in the art that substitution of materials and modification of details obviously can be made without departing from the spirit of the invention.

What I claim is:

1. A resin nozzle positioner for a rock bolter having a frame which supports at least one feed track on which a rock drill is advanced along a work axis toward a rock surface to bore a bolt hole into the rock surface, and on which a bolt driver is advanced along the work axis to drive a bolt into the bolt hole, the resin nozzle positioner comprising:

a positioner base mounted so as to be fixable with respect to the frame;

a pair of arms, each of said pair of arms terminating in an arm base end region and an arm free end region, said arm base end region of each of said pair of arms being pivotably attached to said positioner base so as to pivot about a base pivot axis, said base pivot axes being normal to the work axis and spaced apart at a separation S;

a nozzle block pivotably attached to said arm free end region of each of said pair of arms such that said arm free end region pivots about a block pivot axis, said block pivot axes being normal to the work axis and spaced apart from each other at said separation S, said base pivot axis and said block pivot axis for each of said pair of arms being spaced apart at a separation L which defines the effective length of said pair of arms, thereby assuring that said pair of arms are pivotable and remain at all times substantially parallel to each other;

a resin nozzle having a nozzle passage with a nozzle axis, said nozzle passage passing through said resin nozzle and communicating with a resin hose, said resin nozzle being mounted to said nozzle block such that said nozzle axis and the work axis are parallel and lie in a plane normal to said pivot axes, thereby assuring that the plane in which said nozzle axis moves contains the work axis; and means for displacing said nozzle block with respect to said positioner base to move said resin nozzle between a retracted position, where said nozzle axis is displaced from the work axis, and an extended position, where said nozzle axis is aligned with the work axis and said nozzle passage is in close proximity to the rock surface.

2. The resin nozzle positioner of claim 1 wherein said means for displacing said nozzle block with respect to said positioner base further comprises:

an actuator operatively connected with respect to two elements selected from the group of elements comprising, said pair of arms, said positioner base, and said nozzle block.

3. The resin injector positioner of claim 2 wherein said resin nozzle is slidably and lockably engaged with said nozzle block.

4. The resin injector positioner of claim 3 wherein said positioner base is affixed with respect to the frame.

5. The resin injector positioner of claim 4 wherein said base pivot axes reside in a plane parallel to the work axis.

6. The resin injector positioner of claim 5 wherein said actuator is a linear actuator which further comprises:

a first actuator end which is pivotably attached with respect to said positioner base;

a second actuator end which is pivotably attached with respect to one of said pair of arms at a point spaced apart from said arm base end region; and means for varying the distance between said first actuator end and said second actuator end.

7. The resin nozzle positioner of claim 6 wherein the rock bolter has a centralizer having a centralizer passage extending therethrough, the resin nozzle positioner further comprising:

a nozzle head contoured to substantially conform to the centralizer passage when brought into contact therewith; and further wherein said resin nozzle is mounted on said nozzle block such that, when said nozzle axis is aligned with the centralizer passage, which occurs when nozzle block is in said extended position, said nozzle head is in contact with the centralizer.

8. The resin nozzle positioner of claim 7 wherein said resin nozzle is adjustably mounted to said nozzle block so as to be adjustable along said nozzle axis.

9. The resin nozzle positioner of claim 8 wherein said nozzle head further comprises:

a beveled guide surface configured to guidably engage the centralizer passage as said resin nozzle is moved to said extended position so as to align said nozzle passage with the centralizer passage; and a ramp surface positioned opposite said beveled guide surface.

10. The resin nozzle positioner of claim 9 wherein said beveled guide surface is configured such relative to the centralizer passage that, when said resin nozzle is in said extended position, said nozzle passage and the centralizer passage form a substantially continuous passage.

11. The resin nozzle positioner of claim 1 wherein the rock bolter has a drill feed track traversed by the rock drill and a driver feed track traversed by the bolt driver, the drill feed track and the driver feed track being mounted on a turret which pivots about the work axis so as to sweep out a region having an effective radius r, further wherein said positioner base, said pair of arms, said nozzle block, and said means for displacing said nozzle block are configured such that, in said retracted position, said resin nozzle and said nozzle block are spaced apart from the work axis beyond the effective radius r.

12. The resin nozzle positioner of claim 11 wherein said positioner base is mounted to the frame of the rock bolter such that said plane in which said nozzle axis and the work axis reside does not intersect the drill feed track, the bolt driver, the driver feed track, or the turret when the turret is positioned to align the rock drill with the work axis.

13. A resin nozzle positioner for a rock bolter having a frame which supports a centralizer, having a centralizer axis, and a turret which supports a drill feed track, on which a rock drill is advanced when aligned with the centralizer axis toward a rock surface to bore a bolt hole into the rock surface, and a driver feed track, on which a bolt driver is advanced when aligned with the centralizer axis to drive a bolt into the bolt hole, the turret pivoting about the centralizer axis to align either the rock drill or the bolt driver therewith, the resin nozzle positioner comprising:

a positioner base affixed with respect to the frame;

a pair of arms, each of said pair of arms terminating in an arm base end region and an arm free end region, said arm base end region of each of said pair of arms being pivotably attached to said positioner base so as to pivot about a base pivot axis, said base pivot axes being normal to the centralizer axis and spaced apart from each other at a separation S;

a nozzle block pivotably attached to said arm free end region of each of said pair of arms such that said arm free end region pivots about a block pivot axis, said block pivot axes being normal to the work axis and spaced apart at said separation S, said base pivot axis and said block pivot axis for each of said pair of arms being spaced apart at a separation L which defines the effective length of said pair of arms;

a resin nozzle having a nozzle passage with a nozzle axis, said nozzle passage passing through said resin nozzle and communicating with a resin hose, said resin nozzle being mounted to said nozzle block such that said nozzle axis and the centralizer axis are parallel and lie in a plane normal to said pivot axes, thereby assuring that the plane in which said nozzle axis moves contains the centralizer axis; and means for displacing said nozzle block with respect to said positioner base to move said resin nozzle between a retracted position, where said nozzle axis is displaced from the centralizer axis to avoid interference with rotation of the turret by said resin nozzle or said nozzle block, and an extended position, where said nozzle axis is aligned with the centralizer axis and said nozzle passage is in close proximity to the centralizer.

14. The resin nozzle positioner of claim 13 wherein said positioner base is affixed to the frame of the rock bolter such that said plane in which said nozzle axis and the centralizer axis reside does not intersect the drill feed track, the bolt driver, the driver feed track, or the turret when the turret is positioned to align the rock drill with the centralizer axis.

15. The resin nozzle positioner of claim 14 wherein the drill feed track, the rock drill, the driver feed track, the bolt driver, and the turret sweep out a region having an effective radius r as the turret pivots about the centralizer axis, further wherein said positioner base, said pair of arms, said nozzle block, and said means for displacing said nozzle block are configured such that, in said retracted position, said resin nozzle and said nozzle block are spaced apart from the centralizer axis beyond the effective radius r.

* * * * *